United States Patent [19]

LaBate, II et al.

[11] Patent Number: 4,553,743

[45] Date of Patent: Nov. 19, 1985

[54] ELEVATED DEVICE FOR PLACING SLAG RETENTION MEANS IN TAPPING CONVERTERS

[75] Inventors: Michael D. LaBate, II, Ellwood City; Joseph A. Perri, Coraopolis, both of Pa.

[73] Assignee: Insul Company, Inc., East Palestine, Ohio

[21] Appl. No.: 643,499

[22] Filed: Aug. 23, 1984

[51] Int. Cl.[4] ..... C21B 5/46

[52] U.S. Cl. ..... 266/272; 266/44; 222/597

[58] Field of Search ..... 266/272, 271, 45, 44, 266/236; 222/597, 591, 598, 590

[56] References Cited

U.S. PATENT DOCUMENTS

| | | | |
|---|---|---|---|
| 2,810,169 | 10/1957 | Hofer | 222/591 |
| 3,190,629 | 6/1965 | Draper | 266/271 |
| 3,459,209 | 8/1969 | Kobusch et al. | 222/597 |
| 4,468,013 | 8/1984 | LaBate | 266/272 |
| 4,478,392 | 10/1984 | Fuzii | 266/44 |

FOREIGN PATENT DOCUMENTS

| | | | |
|---|---|---|---|
| 3044087 | 6/1982 | Fed. Rep. of Germany | 266/271 |

*Primary Examiner*—L. Dewayne Rutledge
*Assistant Examiner*—S. Kastler
*Attorney, Agent, or Firm*—Harpman & Harpman

[57] ABSTRACT

An elevated device suspended from an overhead support adjacent a converter adjustably positions a boom for relative vertical tilting and side to side motion. A carriage movable along the boom supports a boom extension and jaws on the boom extension releaseably hold a slag retaining device so that the same can be moved into a converter and positioned in the tap hole thereof.

4 Claims, 2 Drawing Figures

ELEVATED DEVICE FOR PLACING SLAG RETENTION MEANS IN TAPPING CONVERTERS

BACKGROUND OF THE INVENTION

1. Technical Field

This invention relates to an elevated device for accurately and forcefully positioning a slag retaining closure or dart in a tapping converter during the tapping of steel therefrom.

2. Description of the Prior Art

Prior structures of this type are best represented by the disclosures of U.S. Pat. Nos. 3,459,209 and 4,431,169 in which closures are positioned in converters by arms adjustably and movably mounted adjacent the converters and which releaseably hold the closures.

SUMMARY OF THE INVENTION

The present invention utilizes a two part extensible boom similar to the arms of the prior art patents and provides an overhead adjustable support for holding the boom, means for moving the boom vertically and in tilting relation to the overhead support and for imparting limited side to side motion thereto. A carriage is movable along one part of the boom and carries an extension of the boom which in turn has jaws for releaseably holding a slag retention device or dart to be positioned in the tap hole of the converter.

DESCRIPTION OF THE PREFERRED EMBODIMENT

Figure 1:
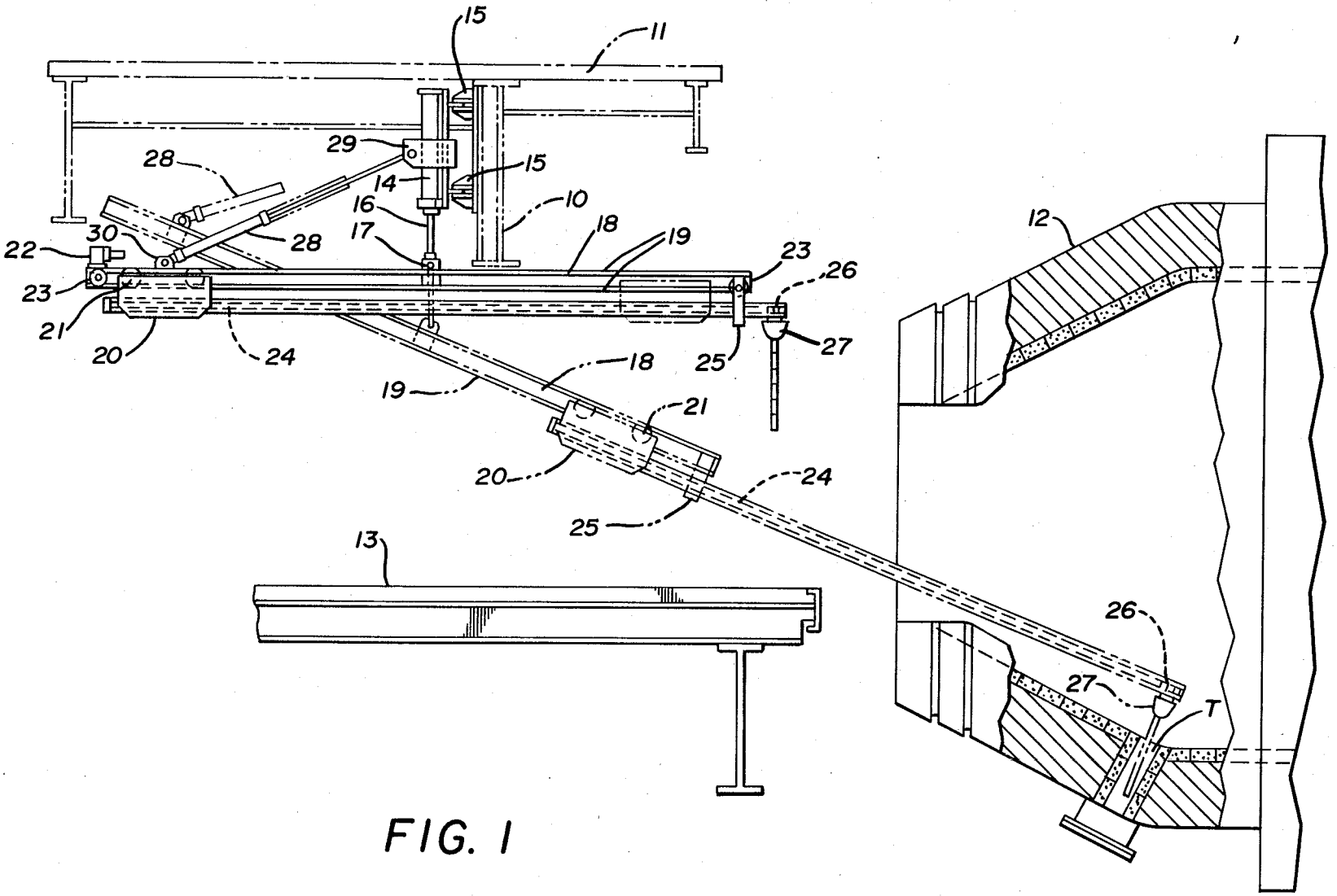
FIG. 1 is a side elevation of the elevated device, a portion of an operating floor therebelow, and a portion of a converter with parts broken away and parts in cross section.
Figure 2:
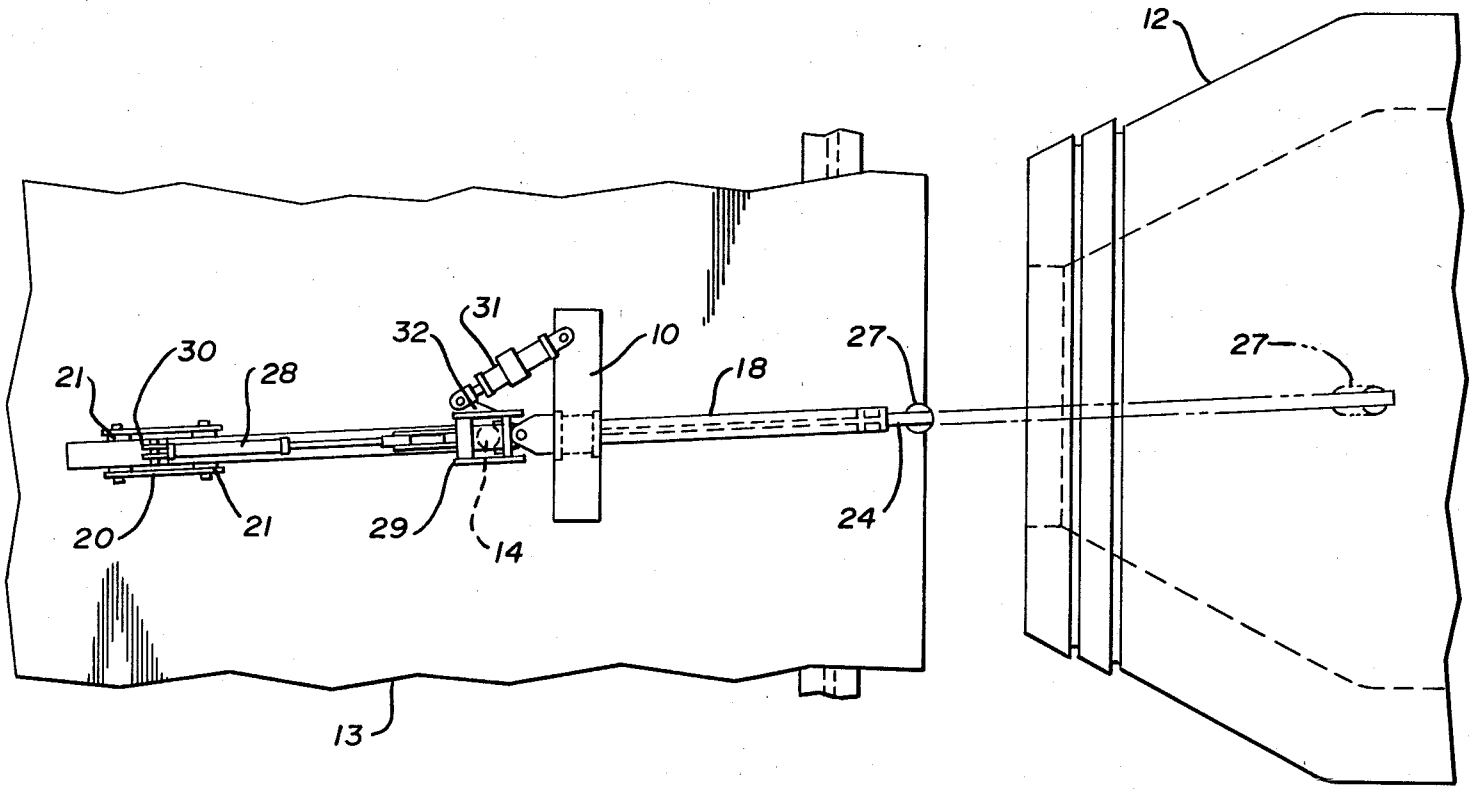
FIG. 2 is a top plan view of the elevated device seen in FIG. 1 of the drawings.

The elevated device for positioning slag retaining devices, such as darts, in tapping converters as used in the steel industry to prevent the flow of slag from the tap hole of the converter is illustrated in its simplest form in FIGS. 1 and 2 of the drawings and by referring to FIG. 1, it will be seen that the device comprises a vertically positioned support member 10 secured at its upper end to a suitable overhead structure 11 such as a portion of an enclosure in which a converter 12 and its usual operating floor 13 are located. A lift and lower piston and cylinder device 14 is pivotally attached by pivot brackets 15 to the vertical support 10 so that the same is movable on an arcuate path relative thereto. A piston rod 16 of the lift and lower piston and cylinder device 14 extends downwardly from the piston and cylinder 14 and is pivotally attached to a bracket 17 midway between the ends of an elongated boom 18. The elongated boom 18 has longitudinally extending guide rails 19 on its opposite sides along which a carriage 20 is movable by reason of rollers 21 on the carriage 20 engaging the longitudinally extending rails 19.

An electric gear motor 22 is positioned on one end of the elongated boom 18 and arranged to drive a flexible member trained over pulleys 23 positioned on each end of the flexible boom 18. The elongated member is attached to the carriage 20 so that energization of the electric gear motor 22 will move the carriage 20 in a desired direction along the elongated boom 18.

Still referring to FIG. 1 of the drawings, it will be seen that a boom extension 24 is carried by the carriage 20 and extends outwardly of one end thereof and through a U-shaped guide 25 on one end of the elongated boom 18. Jaws 26 in the outermost end of the boom extension 24 are adapted to releaseably engage a slag retaining device or dart 27. The elongated boom 18 and the boom extension 24 form the two part extensible boom of the invention.

The jaws 26 may be actuated by a device for imparting movement thereto, which device is mounted in the carriage 20 and remotely controlled. In order that the elongated boom 18 may be tilted on its pivotal mounting on the end of the piston rod 16, a tilt piston and cylinder device 28 is pivotally mounted to a collar 29 on the lift and lower piston and cylinder device 14 and to a secondary bracket 30 on one part of the elongated boom 18 adjacent one end thereof. Means for supplying compressed air to the lift and lower piston and cylinder device 14 and the tilt piston and cylinder device 28 are provided and arranged with remote controls so that the elevated device of the invention can be operated from a remote location.

In FIG. 1 of the drawings, broken lines illustrate an alternate position of the elongated boom 18 and the boom extension 24 as occasioned by lowering the middle portion of the elongated boom 18 and elevating the end thereof pivotally attached to the tilt piston and cylinder device 28. In the broken lines in FIG. 1 of the drawings, the boom extension 24 is shown extended into the open throat of the converter 12 which has been tilted into a pouring position with respect to a tap hole T therein.

By referring now to FIG. 2 of the drawings, a top plan view of the elevated device just described will be seen to include a pivot piston and cylinder 31, one end of which is pivoted to a third bracket 32 on the collar 29 and the other end of which is pivoted to a horizontal portion of the vertical support member 10 heretofore referred to. Acuation moves the elevated device on brackets 15 in an arçuate path.

By referring again to FIG. 1 of the drawings, it will be seen that the vertical support member 10 has horizontal sections on its upper and lower ends so that in effect it becomes a structural member capable of easily supporting the elevated device of the invention from any suitable overhead structure in a mill building or enclosure as indicated by the numeral 11 herein.

Still referring to FIG. 1 of the drawings, it will be observed that the operating floor 13 is freed of any apparatus or mechanism by positioning the elevated device of the invention in spaced relation thereabove and thus provides free and easy access on the operating floor with respect to the converter by the operators of the same. The overhead arrangement of the device of the invention permits the slag retaining devices or darts as they are commonly referred to in the art, to be easily positioned in the jaw assemblies carried in the outer end of the boom extension 24 by workmen on the operating floor 13 as the elevated device of the invention can be pivoted around to position the jaw end of the boom extension 24 in any desired position above the operating floor.

Those skilled in the art will observe that the device is thus easily manipulated so as to be aligned with the throat of the converter 12 and tilted to direct the elongated boom 18 toward the throat whereupon the carriage 20 and the boom extension 24 are easily and directly movable into the converter whereupon appropriate manipulation by the operator easily and quickly positions the slag retaining closure or dart 27 in the tap hole where it prevents slag on the top of the molten steel from entering the tap hole when the steel has substantially drained therethrough.

Having thus described our invention, what we claim is:

1. Apparatus for placing a slag retaining device in a tap hole in a converter comprising a two part boom extensible into said converter, said two part boom including a first part which is movable longitudinally of said second part so that said two part boom is collapsible upon itself, a stationary vertical support member depending from an overhead structure, a lift and lower device mounted on said vertical support member and pivotally engaging said second part of said boom at a first location, a tilt device engaging said lift and lower device and said second part of said boom at a second location which is spaced from said first location for supporting said two part boom and tilting said two part boom with respect to said lift and lower device whereby said two part boom is supported at at least two spaced apart positions, means engaging said lift and lower device and said vertical support member for moving said vertical support member on its longitudinal axis in a rotary motion, a carriage movably mounted on said second part of said boom and means for moving said carriage longitudinally along said boom second part, said first part of said boom affixed at one of its ends to said carriage for movement in a path parallel with said second part of said boom for extending and retracting said boom first part with respect to said boom second part toward and away from said converter and the tap hole therein and means on the other end of said second part of said boom detachably mounting said elongated slag retaining device.

2. The apparatus for placing a slag retaining device in a tap hole in a converter set forth in claim 1 and wherein pivot devices on said vertical support member pivotally engage said lift and lower device so that the same can be moved in a horizontal plane on an arcuate path relative to said vertical support member.

3. The apparatus for placing a slag retaining device in a tap hole in a converter set forth in claim 1 and wherein said first part of said two part boom extensible into said converter consists of an elongated member, guide rails on said elongated member and wherein rollers on said carriage engage said guide rails on said elongated member.

4. The apparatus for placing a slag retaining device in a tap hole in a converter set forth in claim 1 and wherein said means for moving said carriage along said first part of said boom comprise pulleys on the ends of said first part of said boom, a continuous flexible member trained over said pulleys and means for imparting motion to said continuous flexible member and means on said carriage engaging said flexible member.

* * * * *